US008944297B2

(12) United States Patent
Agassi et al.

(10) Patent No.: US 8,944,297 B2
(45) Date of Patent: Feb. 3, 2015

(54) SEALABLE POURER

(75) Inventors: Or Agassi, Tel Aviv (IL); Reuven Marko, Netanya (IL)

(73) Assignee: Agam Innovations Ltd., Netanya (IL)

( * ) Notice: Subject to any disclaimer, the term of this patent is extended or adjusted under 35 U.S.C. 154(b) by 0 days.

(21) Appl. No.: 13/252,345

(22) Filed: Oct. 4, 2011

(65) Prior Publication Data

US 2012/0085790 A1 Apr. 12, 2012

Related U.S. Application Data

(63) Continuation-in-part of application No. 29/394,407, filed on Jun. 16, 2011.

(60) Provisional application No. 61/391,101, filed on Oct. 8, 2010.

(51) Int. Cl.

| | |
|---|---|
| ***B67D 3/00*** | (2006.01) |
| ***B65D 47/32*** | (2006.01) |
| ***B65D 47/26*** | (2006.01) |
| ***B65D 47/28*** | (2006.01) |

(52) U.S. Cl.

CPC ..... *B65D 47/32* (2013.01); *B65D 47/263* (2013.01); *B65D 47/283* (2013.01)

USPC .... 222/481.5; 222/484; 222/482; 222/153.01

(58) Field of Classification Search

USPC ..... 222/478–479, 481.5, 482, 566–567, 222/569, 542, 484

See application file for complete search history.

(56) References Cited

U.S. PATENT DOCUMENTS

| | | | | |
|---|---|---|---|---|
| 2,112,125 | A * | 3/1938 | Von Bultzingslowen | 222/484 |
| 2,642,207 | A * | 6/1953 | Renzi | 222/479 |
| 2,968,423 | A * | 1/1961 | Mahler et al. | 222/49 |
| 3,630,419 | A | 12/1971 | Pierce | |
| 3,796,348 | A | 3/1974 | Zipper | |
| 3,894,661 | A | 7/1975 | Guala | |
| 4,261,484 | A | 4/1981 | DaCosta et al. | |
| 4,376,497 | A * | 3/1983 | Mumford | 222/153.14 |
| 4,384,662 | A | 5/1983 | Boudin et al. | |
| 4,523,687 | A | 6/1985 | Hullihen | |
| 4,877,159 | A * | 10/1989 | Strand | 222/484 |
| 4,984,711 | A | 1/1991 | Ellis | |
| 5,211,318 | A | 5/1993 | Govatzidakis | |
| 5,303,839 | A | 4/1994 | Blumenschein | |
| 5,303,850 | A | 4/1994 | Connan | |
| 5,346,099 | A | 9/1994 | Salmon et al. | |
| 5,713,491 | A | 2/1998 | Hughes et al. | |

(Continued)

OTHER PUBLICATIONS

International Search Authority: "Written Opinion of the International Searching Authority" (PCT Rule 43bis.1) including International Search Report for International Patent Application No. PCT/IL 11/00783; Date of Mailing: May 4, 2012.

(Continued)

*Primary Examiner* — Paul R Durand
*Assistant Examiner* — Jeremy W Carroll
(74) *Attorney, Agent, or Firm* — M&B IP Analysts, LLC

(57) ABSTRACT

A sealable pourer for mounting on a bottle. The sealable pourer includes a cap to ensure that the pouring nozzle and air tube outlet are sealed, or otherwise closed, when in a first position of the cap and allow free flow of the liquid content of the bottle when in a second position. In one embodiment, the cap is rotated about a symmetry axis of the nozzle to achieve sealing of both the air passage and the pouring nozzle.

15 Claims, 12 Drawing Sheets

(56) References Cited

U.S. PATENT DOCUMENTS

| | | | | |
|---|---|---|---|---|
| 5,961,008 | A | 10/1999 | Peckels | |
| 6,123,225 | A | 9/2000 | Peckels | |
| 6,149,022 | A * | 11/2000 | Akyildiz et al. | 215/222 |
| 6,364,178 | B1 | 4/2002 | Paczonay | |
| 6,568,660 | B1 | 5/2003 | Flanbaum | |
| 6,742,678 | B1 * | 6/2004 | Krystopik, Jr. | 222/481.5 |
| 7,040,515 | B2 * | 5/2006 | Cote | 222/481.5 |
| 7,237,692 | B2 | 7/2007 | Bodum | |
| 7,407,067 | B2 | 8/2008 | Kerkhof et al. | |
| D587,571 | S | 3/2009 | Gonzales, Jr. | |
| D591,594 | S | 5/2009 | Jalet | |
| 7,622,039 | B2 | 11/2009 | Farrell et al. | |
| 7,806,303 | B1 | 10/2010 | Hastings | |
| D633,753 | S | 3/2011 | White | |
| 8,011,540 | B1 | 9/2011 | Peckels | |
| 2005/0194410 | A1 | 9/2005 | Pham | |
| 2006/0000855 | A1 | 1/2006 | Allen et al. | |
| 2008/0017675 | A1 | 1/2008 | Pressey | |
| 2008/0073383 | A1 | 3/2008 | McDonald | |
| 2008/0099514 | A1 | 5/2008 | Carter et al. | |
| 2008/0237178 | A1 | 10/2008 | Ochoa Laburu | |
| 2008/0272147 | A1 * | 11/2008 | Buker et al. | 222/113 |
| 2009/0008356 | A1 | 1/2009 | Gadzic et al. | |
| 2010/0006590 | A1 | 1/2010 | Withoos et al. | |
| 2010/0038378 | A1 | 2/2010 | Gabler et al. | |
| 2010/0091605 | A1 | 4/2010 | Rasmussen et al. | |
| 2010/0230447 | A1 | 9/2010 | Eriksen | |
| 2011/0024383 | A1 | 2/2011 | Mckenna et al. | |
| 2011/0024453 | A1 | 2/2011 | Fleisher | |
| 2011/0024925 | A1 | 2/2011 | Mauffette | |

OTHER PUBLICATIONS

European Search Report and Written Opinion, Feb. 28, 2014.

Office Action, State Intellectual Property Office of the P.R.C., Chinese Patent Application No. 201180048571.7, Issue Document No. 2014082800538200, Sep. 2, 2014.

Technical Examination, Colombian Patent Office, Patent Application in Columbia No. 13-089623, PCT/US2011/025669, Aug. 1, 2014.

Office Action, Japanese Patent Office, Japanese Patent Application No. 2014-503274, Mailing No. 549509, Oct. 21, 2014.

Patent Examination Report No. 1, Australian Patent Application No. 2011371175, Australian Government Patent Office, Sep. 26, 2014.

* cited by examiner

SEALABLE POURER

CROSS-REFERENCE TO RELATED APPLICATIONS

This application claims the benefit of U.S. provisional application No. 61/391,101 filed on Oct. 8, 2010. This application is also a continuation-in-part of US design application No. 29/394,407 filed on Jun. 16, 2011. The contents of the above-referenced applications are incorporated herein by reference.

TECHNICAL FIELD

The invention relates to a pourer that is placed on a container, for example a bottle, for the dispensing of liquids. More specifically the invention relates to a pourer where both an air opening and a liquid opening are sealable or otherwise closeable.

BACKGROUND OF THE INVENTION

Generally, pourers have a nozzle that is used for the dispensing of liquid and generally formed as a tube in some form or shape. The pourer further generally contains an air tube that allows air to enter the container as liquid is dispensed, otherwise the flow of the liquid may be disrupted, as is well known in the art.

When dispensing beverages such as alcoholic beverages a pourer is placed on the bottle for the purpose of making it easier for the bar person to dispense the beverage quickly and efficiently. Typical pourers are not sealable and remain open. The problem of leaving the pourer on the bottle is that at the end of the work day it is necessary to somehow seal the pourer to prevent the tendency of various insects to be drawn to the sugars associated with the presence of such alcoholic beverages which may then render the bottle useless for future use. U.S. Pat. No. 3,630,419 addresses partially the problem by placing a lid on the nozzle, such that when the bottle is tilted the lid opens and allows for the flow of liquid while when placed vertically the lid, due to gravity, closes. To ensure that the air tube is also sealed the opening of the air tube is inside of the pouring nozzle which, when significant amount of beverage is dispensed at a time may cause the effect of having no air opening and disrupting the regular flow of the liquid. This is a disadvantage for the work of a person at the bar where the relationship of income to ability to quickly dispense alcohol is known and required. No other prior art seems to solve the problem effectively.

In view of the shortcomings of the prior art it would be advantageous to effectively seal both the pouring nozzle as well as the air tube of a pourer. It would be further advantageous if such a solution would not impact the efficiency of the work of a bartender. It would be further advantageous if the air tube opening would not be inside the nozzle tube.

SUMMARY OF THE INVENTION

Certain embodiments disclosed herein include a sealable pourer. The sealable pourer comprises a base having a first side and a second side, wherein the base is designed to fit over the opening of a container containing a liquid and having a hollow between the first side and the second side to enable the passage of the liquid through the base; a fixture affixed to the first side of the base equipped with at least an engagement element, the engagement element designed to engage to the neck portion of the container, the fixture being hollow to allow flow of liquid through the fixture; a nozzle affixed to the second side of the base and having an opening to allow the pouring of the liquid through the opening; an air tube protruding the nozzle at a side that is opposite to the opening in the nozzle to allow for air to flow into the container when liquid is poured through the pourer's opening in the nozzle; and a cap engaged with the nozzle having a first opening generally conforming to the opening of the nozzle and a second opening having a shape generally conforming to the protruding air tube, the cap having a first position about the nozzle where the first opening is not aligned with the opening of the nozzle and the second opening is not aligned with the protruding air tube, and a second position about the nozzle where the first opening is aligned with the opening of the nozzle and the second opening is aligned with the protruding air tube, wherein when the cap is in the first position liquid cannot be poured out of the pourer and in the second position liquid can be poured out of the pourer.

Certain embodiments disclosed herein also include a sealable pourer being affixed to a liquid container. The sealable pourer comprises a cone shaped nozzle with a first opening for pouring liquid and a second opening comprising a hollow tube for allowing air flow into the container when liquid is poured from the container; and a cap fitting over the nozzle having a first opening generally corresponding to the first opening of the nozzle and a second opening generally corresponding to the second opening of the nozzle, the cap having a first position about the nozzle where the first opening of the cap is not aligned with the first opening of the nozzle and the second opening of the cap is not aligned with the second opening of the nozzle, and a second position about the nozzle where the first opening of the cap is aligned with the first opening of the nozzle and the second opening of the cap is aligned with the second opening of the nozzle, wherein when the cap is in the first position liquid cannot be poured out of the pourer and in the second position liquid can be poured out of the pourer.

BRIEF DESCRIPTION OF THE DRAWINGS

The subject matter that is regarded as the invention is particularly pointed out and distinctly claimed in the claims at the conclusion of the specification. The foregoing and other objects, features and advantages of the invention will be apparent from the following detailed description taken in conjunction with the accompanying drawings.

DETAILED DESCRIPTION OF THE INVENTION

Certain exemplary embodiments of the invention include a sealable pourer for mounting on a bottle. The sealable pourer is equipped with a cap to ensure that the pouring nozzle and air tube outlet are sealed, or otherwise closed, when in a first position of the cap and allow free flow of the liquid content of the bottle when in a second position. In one embodiment, the cap is rotated about a symmetry axis of a cone shaped nozzle to achieve sealing of both the air passage and the pouring nozzle.

Figure 1:
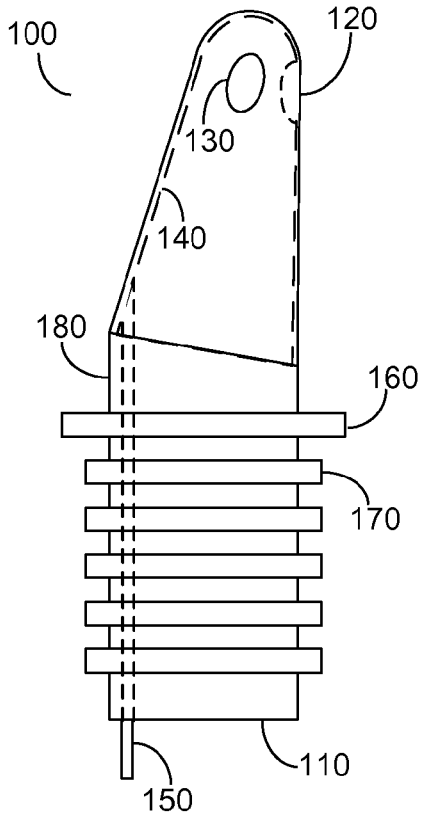
FIG. 1 is a schematic diagram of a pourer in accordance with the principles of the invention from a front side showing the sealing of the liquid nozzle by a twisting cap.
Figure 2:
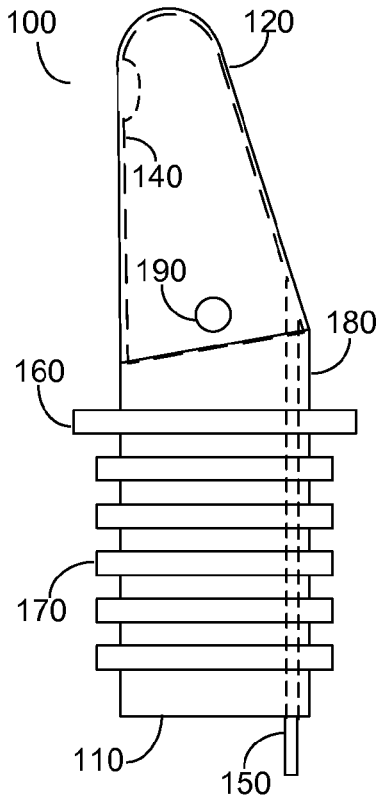
FIG. 2 is a schematic diagram of the pourer from a back side showing the sealing of the air tube by a twisting cap.
Figure 3:
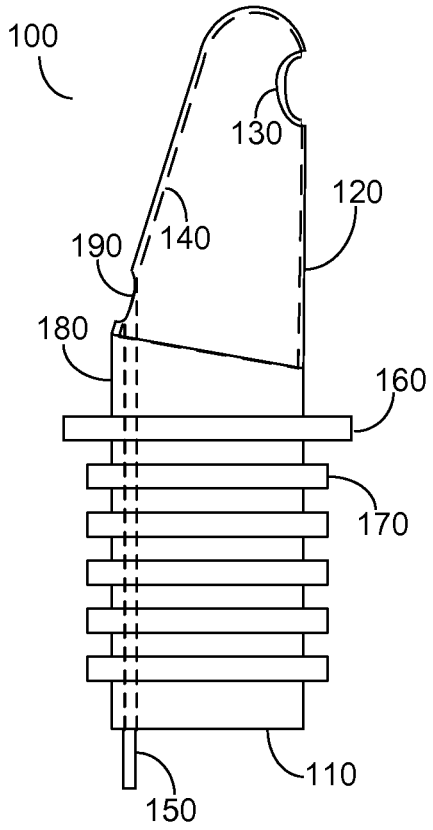
FIG. 3 is a schematic diagram of the pourer in an opened (dispense) position by a twisting cap.

Reference is made to FIGS. 1, 2 and 3 where exemplary and non-limiting schematic diagrams of a pourer 100 implemented in accordance with an embodiment of the invention is shown. FIG. 1 depicts the pourer 100 from a front view in the sealed position. The pourer 100 is comprised of a fixture 110 that is hollow and equipped with engaging elements 170 that secure the pourer 100 in a bottle's neck (not shown). The fixture 110 is affixed to a base 180, also hollow that is further equipped with a stopper 160. The base 180 provides a tilting of the nozzle as further explained herein below. The stopper 160 provides sealing of the bottle opening once the pourer is inserted all the way in, and further prevents pushing the pourer into the bottle beyond a predefined position.

A nozzle 140 is affixed to the base 180 and is also hollow. It has an opening that allows liquid to flow through from the bottle, through the hollow fixture 110 and hollow base 180 so that the liquid can be dispensed from the bottle. In an embodiment of the invention the nozzle 140 is cone-shaped. An air tube 150 is affixed to the nozzle 140 and protrudes through the nozzle 140 such that the airflow in not impacted by the flow of liquid inside of the nozzle 140 itself.

The sealing of the nozzle, is provided by a cap 120 mounted over the nozzle 140. The cap 120 includes a first opening 130 generally corresponding to the opening in the nozzle 140 in size and a second opening 190 generally corresponding to the opening in the nozzle 140 resulting from the protrusion of the air tube 150 through the side of the nozzle 140.

The cap 120 rotatable about a symmetry axis of the nozzle 140. In an embodiment, the cap 120 is horizontally rotatable about a symmetry axis of the nozzle 140 between two positions, one of which includes a stopper. In FIG. 1 a front view of the pourer 100 is shown where the cap is in a position where the first opening 130 is not aligned with the corresponding opening in the nozzle 140. This is achieved, for example, by twisting the cap 120 sufficiently to achieve this goal, for example by 90 degrees. Similarly, in FIG. 2 a back view of the pourer 100 is shown where the cap is in a position where the second opening 190 is not aligned with the corresponding opening for the air tube 150. The result is that in this position the pourer is sealed and the liquid content cannot be poured.

In FIG. 3, the cap 120 is twisted such that the first opening 130 is aligned with the opening in the nozzle 140 and the second opening 190 is aligned with an opening of the air tube 150. In this position, liquid may be easily dispensed from the pourer 100. It would be further understood that while a cone design was shown other designs may be used without departing from the various embodiments of the invention. However, this solution is best suitable for symmetrical nozzles.

Figure 4:
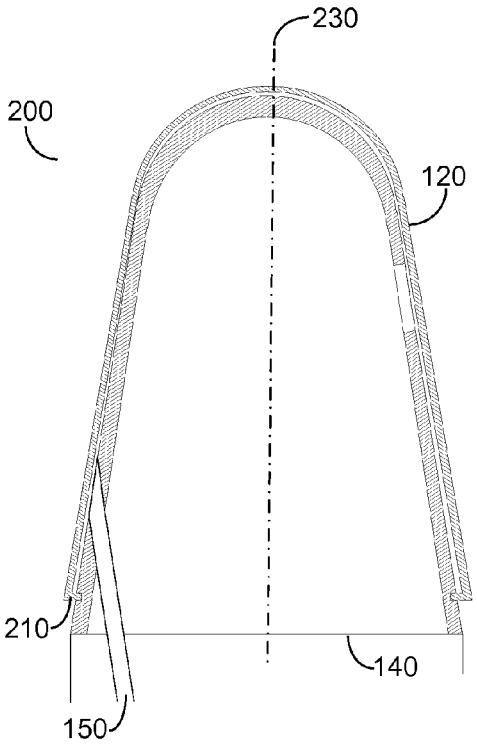
FIG. 4 is a cross section of a portion of the pourer in a sealed position by a twisting cap.
Figure 5:
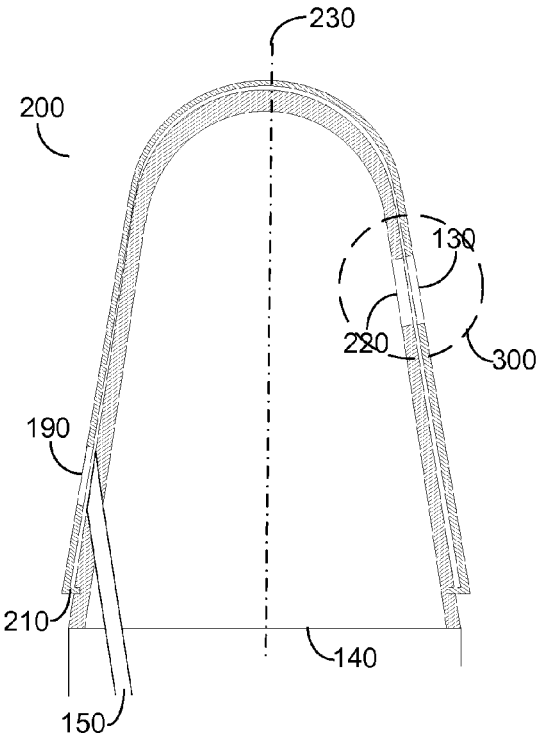
FIG. 5 is a cross section of a portion of the pourer in an opened position by a twisting cap.
Figure 6:
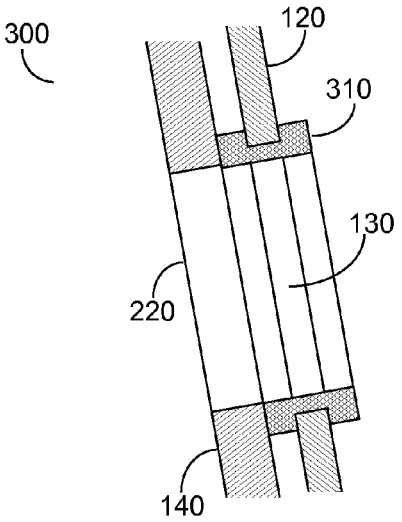
FIG. 6 is an enlargement of the area of the pouring nozzle in an opened position with a sealing o-ring.
Figure 7:
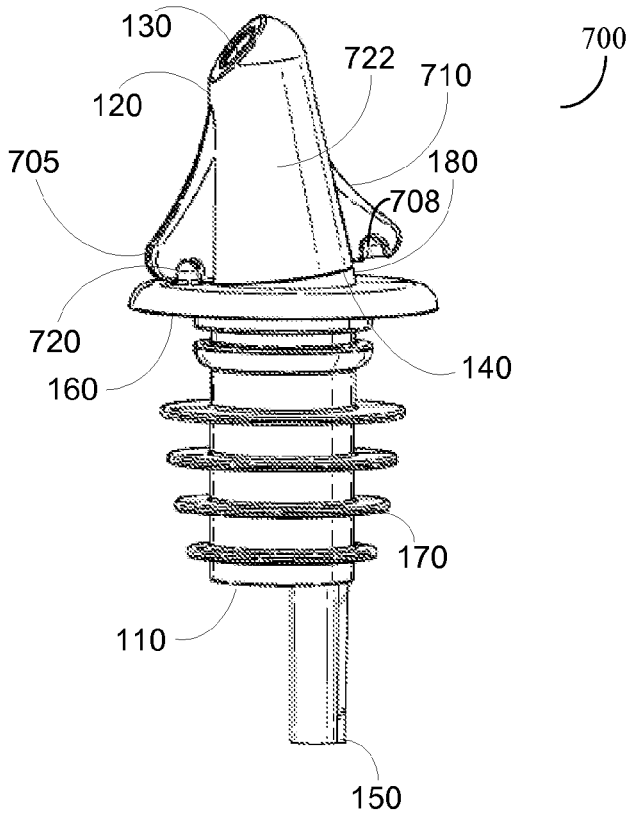
FIG. 7 is a right side isometric view of one embodiment of a sealable pourer assembly.
Figure 8:
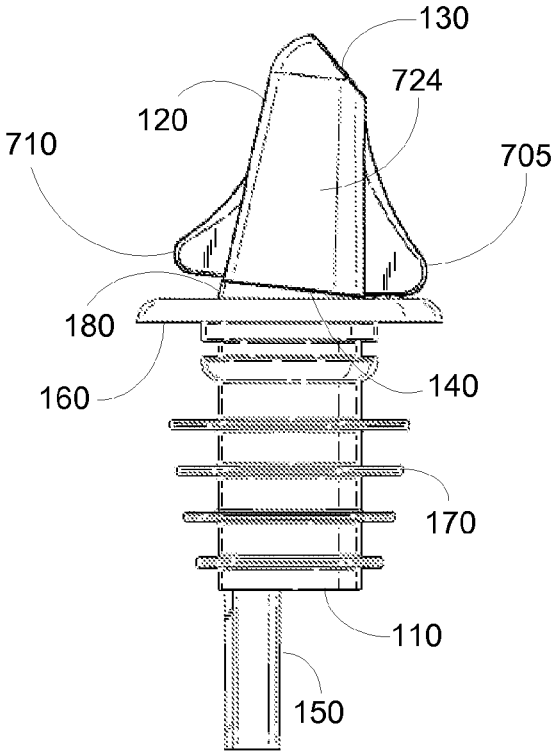
FIG. 8 is a left side elevation view thereof.
Figure 9:
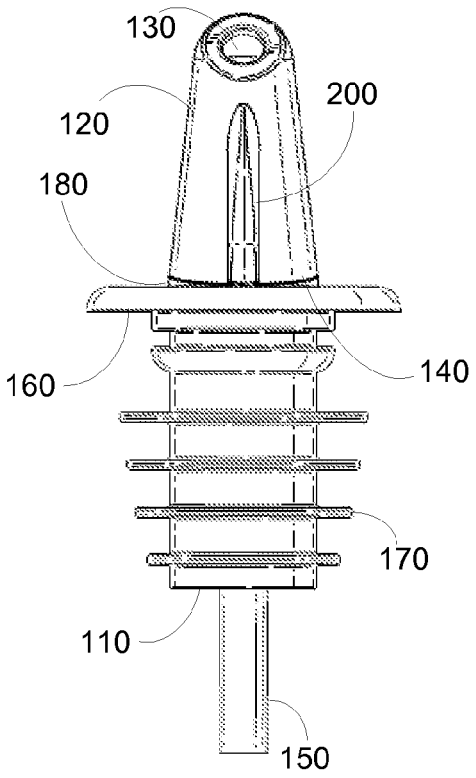
FIG. 9 is a front elevation view thereof.
Figure 10:
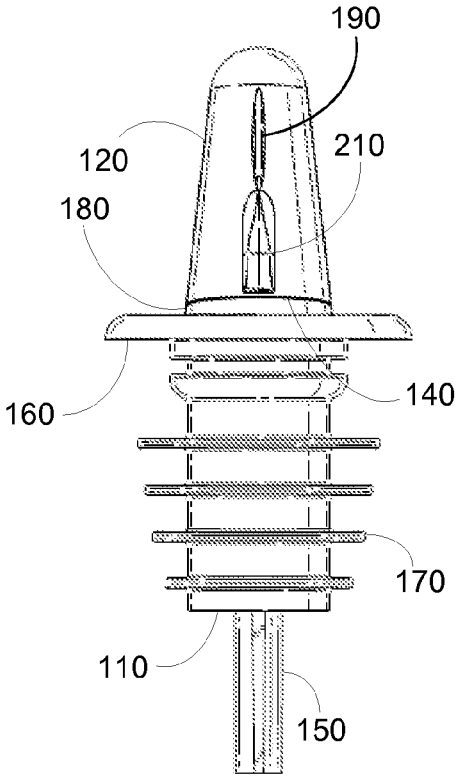
FIG. 10 is a rear elevation view thereof.
Figure 11:
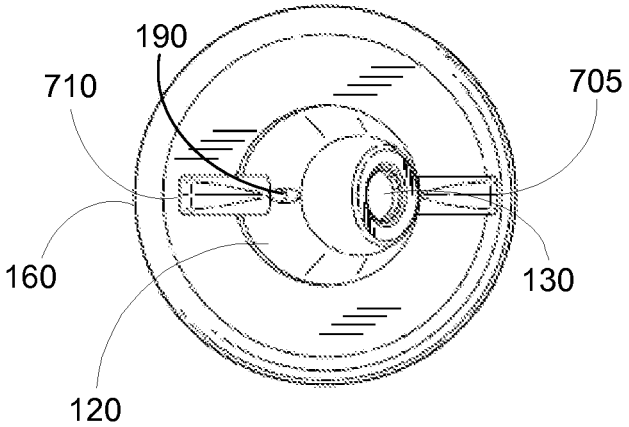
FIG. 11 is a top view thereof.
Figure 12:
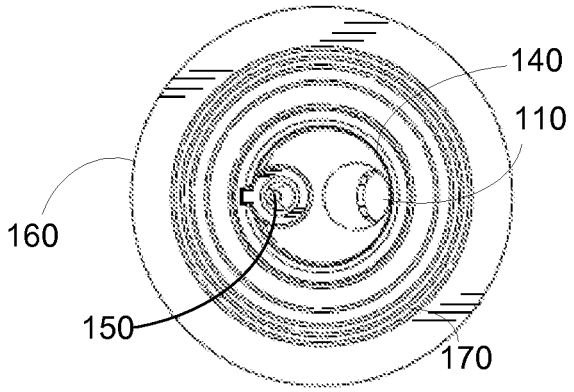
FIG. 12 is a bottom view thereof.
Figure 13:
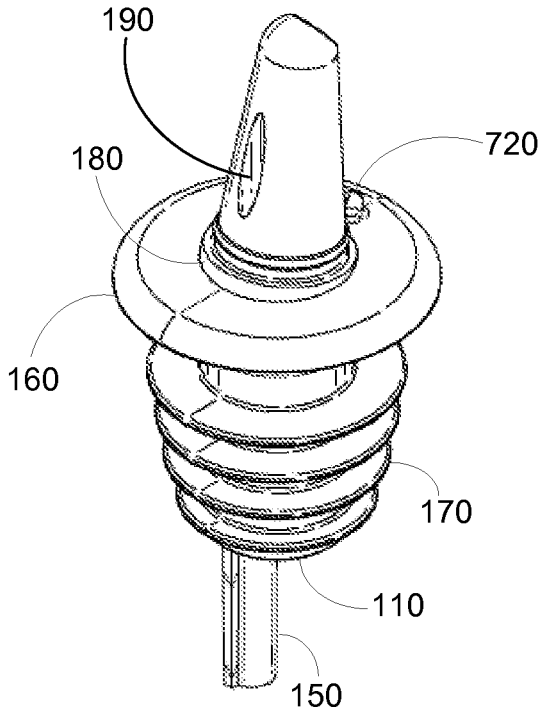
FIG. 13 is a left rear isometric view of another embodiment of a sealable pourer.
Figure 14:
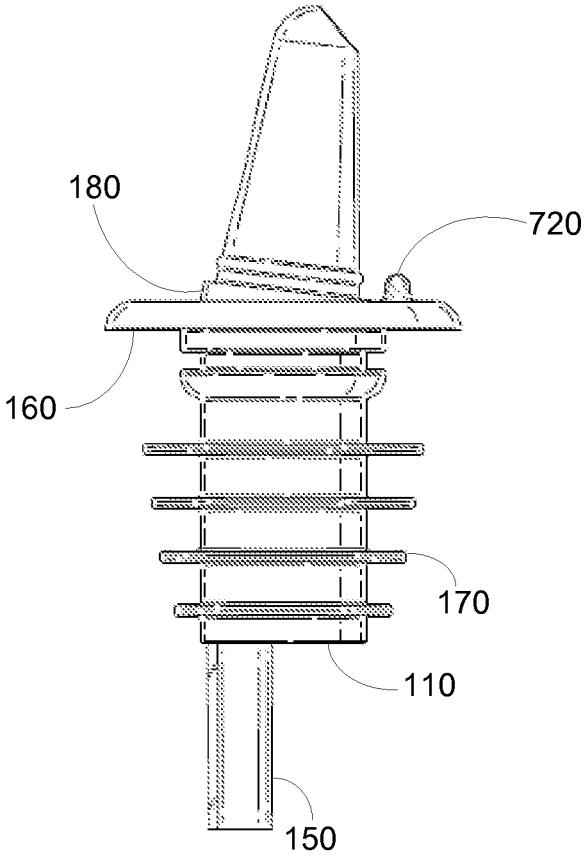
FIG. 14 is a left side elevation view thereof, the right side elevation being identical.
Figure 15:
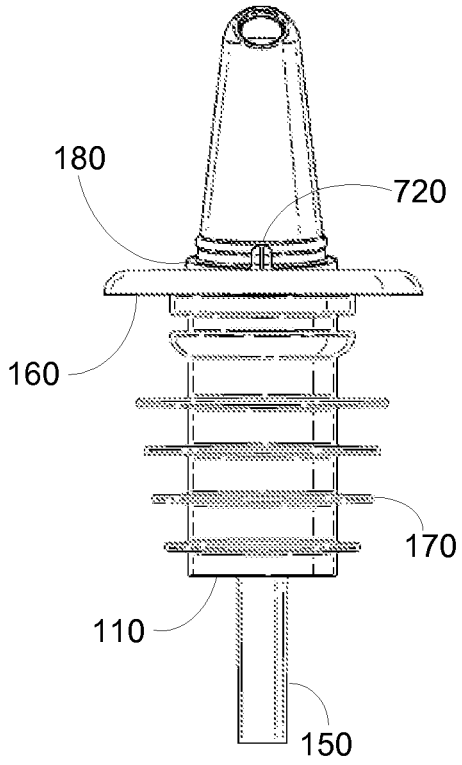
FIG. 15 is a front elevation view thereof.
Figure 16:
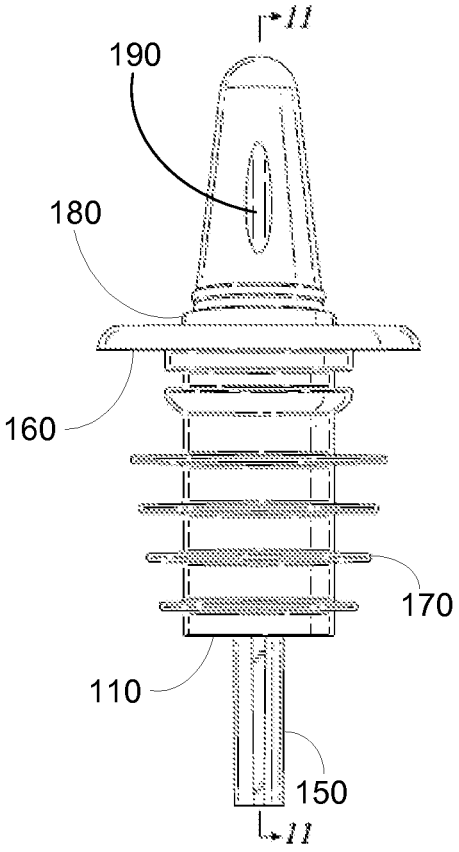
FIG. 16 is a rear elevation view thereof.
Figure 17:
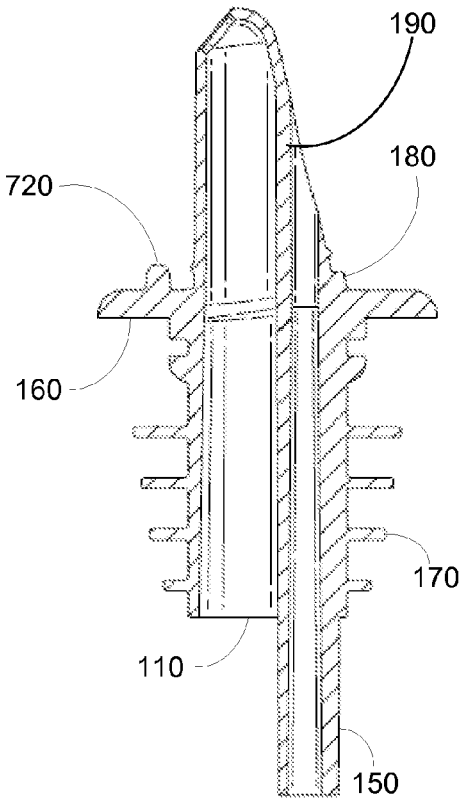
FIG. 17 is a cross-section taken along line 11-11 in FIG. 16.
Figure 18:
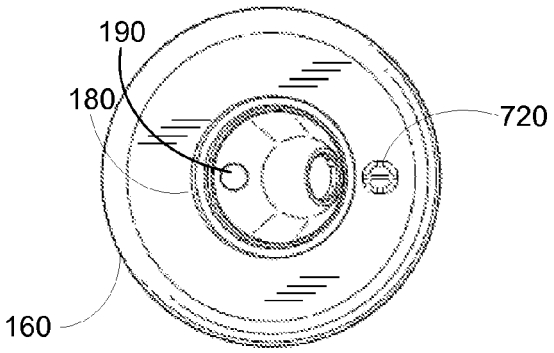
FIG. 18 is a top view thereof.
Figure 19:
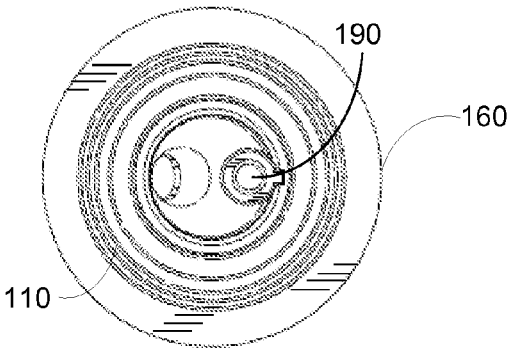
FIG. 19 is a bottom view thereof.
Figure 20:
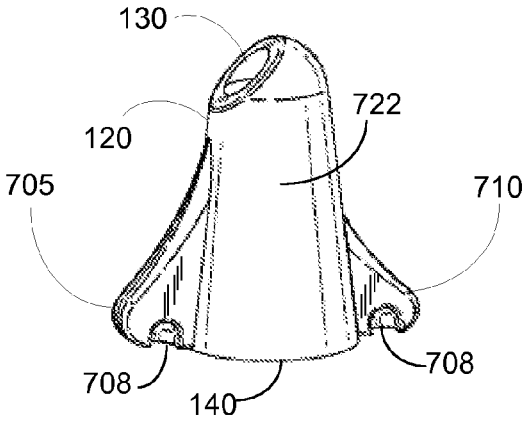
FIG. 20 is a right side isometric view of one embodiment of a cap of the sealable pourer.
Figure 21:
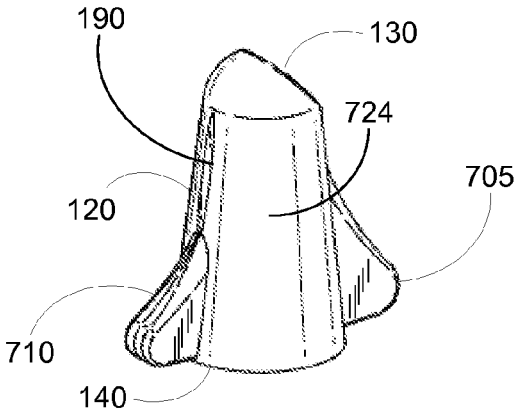
FIG. 21 is a left side isometric view thereof.
Figure 22:
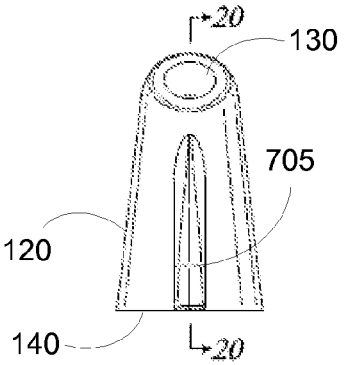
FIG. 22 is a front elevation view thereof.
Figure 23:
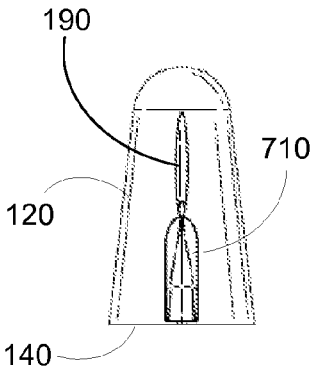
FIG. 23 is a rear elevation view thereof.
Figure 24:
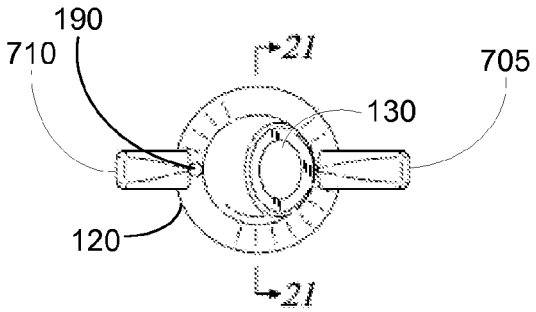
FIG. 24 is a top view thereof.
Figure 25:
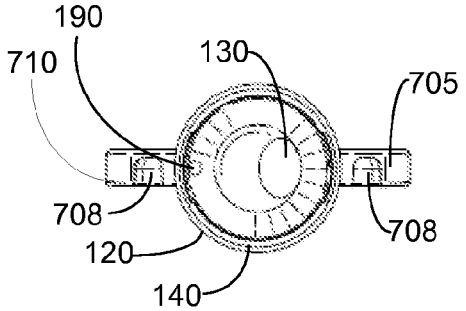
FIG. 25 is a bottom view thereof.
Figure 26:
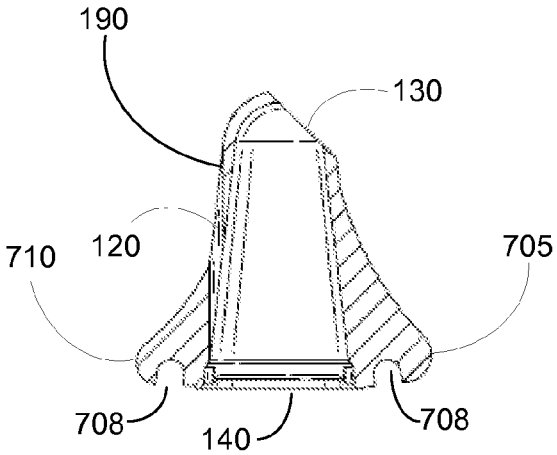
FIG. 26 is cross-section taken along line 20-20 in FIG. 22.
Figure 27:
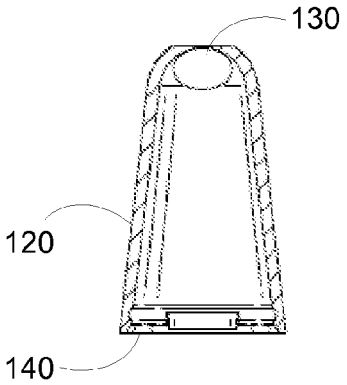
FIG. 27 is a cross-section taken along line 21-21 in FIG. 24.

FIGS. 4, 5 and 6, show various cross sections 200 of a portion of the pourer to further explain its operation. In FIG. 4 the cap 120 is in a sealing position. The cap 120 is further equipped with a rim 210 that corresponds to niches 708 in the nozzle 140 so that once the cap 120 is placed over the nozzle 140 it is generally locked in one of its two positions. It should be noted that the rim 210 may include an o-ring affixed on the cap 120.

The air tube 150 is shown to protrude through the side of the nozzle 140. In this position both the air tube 150 and the pouring opening of the nozzle 140 are blocked by the cap 120. In FIG. 5, the cap is twisted about the symmetry axis 230 such that the first opening 130 corresponds to the pouring opening of the nozzle 140 and the second opening 190 corresponds to the air tube 150. In this position pouring can take place.

To further enable tight sealing of the openings, for example, the first opening 130, may be equipped with a sealing o-ring, as shown with respect of cross-section 300 of FIG. 6. In this embodiment, the o-ring is placed over the opening 130 to ensure sealing so that the beverage does not pour into the slightest gap between the nozzle 140 and the cap 120. An o-ring may of course be used also with the second opening 190. In one embodiment of the invention, the cap 120 is coated with a sealing material layer (not shown) to ensure better sealing between the nozzle 140 and the cap 120. Such a sealing layer may be made of various materials including, but not limited to, rubber, Teflon®, or any other appropriate sealing material. In yet another embodiment of the invention, the rim 210 is designed to allow locking of the cap 120 with respect of the nozzle 140 so that the cap cannot inadvertently swivel around the axis 230.

FIGS. 7 through 27 depict an embodiment of the pourer 700, wherein the cap 120 is equipped with turning wings, for example turning (twisting) wings 705 and 710, that may be appropriately positioned to allow the user to grip and move the cap 120 between the closed and opened positions of the pourer 700 with ease. A stopper 720 stops the twist of the cap 120 at the closed or opened positions. In an embodiment of the invention, a logo, an icon, a text, or the like, can be printed, embossed, or otherwise affixed to, for example, any one of the sides 722 or 724 of the cap 120.

Figure 28:
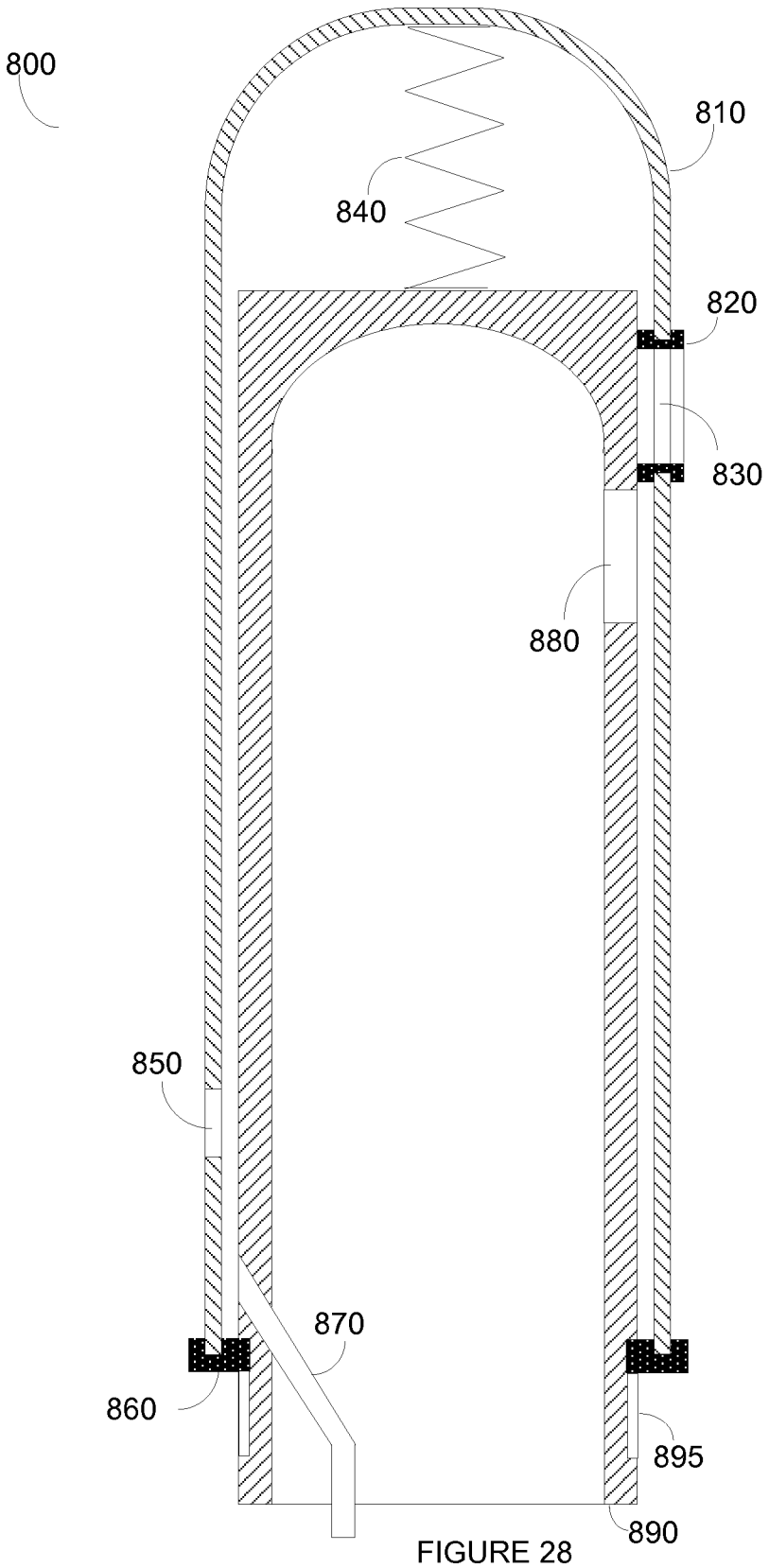
FIG. 28 is a schematic diagram of a portion of a pourer accordance with an embodiment of the invention having a spring mounted sliding cap.

Another embodiment of the invention is shown in FIG. 28, which demonstrates an exemplary and non-limiting schematic diagram of a portion of a pourer 800 having a spring mounted sliding cap 810 that is biased toward the sealed position. For simplicity only the upper portion of the pourer is shown and it can be affixed to the base 180 instead of the nozzle 140 discussed with respect of FIGS. 1-27 above.

The nozzle 890 has a first opening 880 for the dispensing of the liquid. It is further equipped with an air tube 870 protruding through the side of the nozzle 890 to allow the flow of air into the container as was explained herein above. The sliding cap 810 has a rim 860 to fit around the nozzle 890, fitting into a niche 895 to allow the sliding cap 810 to move up and down with respect of the slot 890. The sliding cap 810 is equipped with a first opening 830 to correspond to the opening 880 of the nozzle 890, and a second opening 850 to correspond with the air tube 870. A spring 840 is mounted between the sliding cap 810 and the top of the nozzle 890. Upon pressing on the sliding cap 810 the spring 840 becomes depressed, the rim 860 slides within the slot 895, thereby depressing the spring 840, and as a result aligning the opening 830 with the opening 880 becomes aligned and the opening 850 with the opening of the air tube 870. Hence, with the sliding cap 810 in the depressed position it is possible to pour the liquid, while in the released position the pourer 800 is sealed.

In one embodiment, a sealing o-ring is placed, for example, on the first opening 820 for better sealing. In yet another embodiment, a locking mechanism (not shown) is used to lock the sliding cap in the depressed position when pressed downwards. Another press releases the sliding cap to return to its original and locked position. In another embodiment, the spring 840 is replaced by other means, such as pneumatic means, enabling the depressing and release of the sliding cap 810 with respect of the nozzle 890.

A person skilled-in-the-art will readily note that other embodiments of the invention may be achieved without departing from the scope of the disclosed invention. For example, but not by way of limitation, other bases and/or engaging elements may be used to affix the nozzle to the opening of the container of a liquid. All such embodiments are included herein. The scope of the invention should be limited solely by the claims thereto.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A sealable pourer, comprising:

a base having a first side and a second side, wherein the base is designed to fit over the opening of a container containing a liquid and having a hollow between the first side and the second side to enable the passage of the liquid through the base;

a fixture affixed to the first side of the base equipped with at least an engagement element, the engagement element designed to engage to the neck portion of the container, the fixture being hollow to allow flow of liquid through the fixture;

a hollow cone-shaped nozzle affixed to the second side of the base and having an orifice to allow the pouring of the liquid through the orifice, wherein the cone-shaped nozzle is structured to have a rotational symmetry at least with respect to outer walls of the cone-shaped nozzle;

an air tube protruding from the cone-shaped nozzle at a side that is opposite to the orifice in the cone-shaped nozzle to allow for air to flow into the container when liquid is poured through the pourer's orifice in the cone-shaped nozzle; and a cap engaged with the cone-shaped nozzle having a first orifice generally conforming in shape to the orifice of the cone-shaped nozzle and a second orifice generally in a shape of the orifice of the protruding air tube in the cone-shaped nozzle, the hollow of the cap having inner walls tightly conforming to the cone-shaped outer walls of the cone-shaped nozzle wherein the second orifice is arranged in a longitude direction on the cap, at any rotational position of the cap about the cone-shaped nozzle, the cap having a first position about the cone-shaped nozzle where the first orifice is not aligned with the orifice of the cone-shaped nozzle and the second orifice is not aligned with the protruding air tube, and the cap having a second position about the cone-shaped nozzle where the first orifice is aligned with the protruding air tube of the cone-shaped nozzle and the second orifice is aligned with the protruding air tube of the cone-shaped nozzle, wherein when the cap is in the first position liquid cannot be poured out of the pourer and wherein when the cap is in the second position liquid can be poured out of the pourer.

2. The pourer of claim 1, further comprises an o-ring for the sealing of at least one of: the orifice of the cone-shaped nozzle, the first orifice and the second orifice.

3. The pourer of claim 1, wherein the hollow of the cap is coated with a sealing material layer.

4. The pourer of claim 1, further comprises:

a niche at least partially around the cone-shaped nozzle; and a rim at least partially around the inner wall of the cap fitting the niche around the cone-shaped nozzle.

5. The pourer of claim 4, further comprises: a locking mechanism to lock the cap into any one of the first position and the second position.

6. The pourer of claim 4, wherein the rim is an o-ring affixed to the cap.

7. The pourer of claim 1, wherein the cap is rotatable about a symmetry axis of the cone-shaped nozzle between the first position and the second position to achieve sealing of both the first orifice and the second orifice of the cone-shaped nozzle.

8. The pourer of claim 7, wherein the motion of the cap about the rotational symmetry axis of the cone-shaped nozzle is restricted to be between the first position and the second position.

9. The pourer of claim 1, wherein the cap further comprises at least one of: a printed logo on at least one side, an embossed logo on at least one side, a printed icon on at least one side, an embossed icon on at least one side, a printed text on at least one side, and an embossed text on at least one side.

10. A sealable pourer being affixed to a liquid container, comprising:

a hollow cone-shaped nozzle affixed to the liquid container with a first orifice for pouring liquid and a second orifice comprising a hollow tube for allowing air flow into the liquid container when liquid is poured from the liquid container, wherein the cone-shaped nozzle is structured to have a rotational symmetry at least with respect to outer walls of the cone-shaped nozzle and wherein the first orifice is in a top point of the cone-shaped nozzle; and a cap fitting over the cone-shaped nozzle having a first orifice corresponding to the first orifice of the cone-shaped nozzle and a second orifice generally corresponding in shape to the second orifice of the cone-shaped nozzle, wherein the second orifice is arranged in a longitude direction on the cap, the cap having a first position about the cone-shaped nozzle where the first orifice of the cap is not aligned with the first orifice of the cone-shaped nozzle and the second orifice of the cap is not aligned with the second orifice of the cone-shaped nozzle, and a second position about the cone-shaped nozzle where the first orifice of the cap is aligned with the first orifice of the cone-shaped nozzle and the second orifice of the cap is aligned with the second orifice of the cone-shaped nozzle, wherein when the cap is in the first position liquid cannot be poured out of the pourer and in the second position liquid can be poured out of the pourer.

11. The pourer of claim 10, further comprises: an o-ring for sealing of at least one of: the orifice of the cone-shaped nozzle, the first orifice, and the second orifice.

12. The pourer of claim 10, wherein the hollow of the cone-shaped nozzle is coated with a sealing material layer.

13. The pourer of claim 10, further comprises:

a niche at least partially around the cone-shaped nozzle; and a rim at least partially around the inner wall of the cap fitting the niche around the cone-shaped nozzle.

14. The pourer of claim 10, wherein the cap is rotatable about a rotational symmetry axis of the cone-shaped nozzle between the first position and the second position to achieve sealing of both the first orifice and the second orifice of the cone-shaped nozzle.

15. The pourer of claim 10, wherein the cap further comprises at least one of: a printed logo on at least one side, an embossed logo on at least one side, a printed icon on at least one side, an embossed icon on at least one side, a printed text on at least one side, and an embossed text on at least one side.

* * * * *